US011636989B2

(12) United States Patent
Fujihara et al.

(10) Patent No.: US 11,636,989 B2
(45) Date of Patent: Apr. 25, 2023

(54) TRIGGER SWITCH

(71) Applicant: OMRON Corporation, Kyoto (JP)

(72) Inventors: Takumi Fujihara, Kyoto (JP); Taiki Koyama, Kyoto (JP); Kazushi Maeta, Kyoto (JP)

(73) Assignee: OMRON Corporation, Kyoto (JP)

( * ) Notice: Subject to any disclaimer, the term of this patent is extended or adjusted under 35 U.S.C. 154(b) by 0 days.

(21) Appl. No.: 17/527,265

(22) Filed: Nov. 16, 2021

(65) Prior Publication Data

US 2022/0181101 A1 Jun. 9, 2022

(30) Foreign Application Priority Data

Dec. 4, 2020 (JP) ..... JP2020-202102

(51) Int. Cl.
*H01H 13/14* (2006.01)

(52) U.S. Cl.
CPC ..... *H01H 13/14* (2013.01)

(58) Field of Classification Search
CPC ..... H01H 2013/00; H01H 2013/02; H01H 2013/50; H01H 2013/52; H01H 2013/56; H01H 2207/00; H01H 2207/03; H01H 2221/00; H01H 2221/024; H01H 2231/048; H01H 3/00; H01H 3/02; H01H 3/12; H01H 3/32; H01H 3/54; H01H 2239/078; H01H 2003/00; H01H 2003/12; H01H 2003/32; H01H 21/00; H01H 21/02; H01H 21/18; H01H 21/22; H01H 21/24; H01H 21/36; H01H 13/14; H01H 13/12; H01H 13/20; H01H 13/54; H01H 13/705; H01H 13/85; B25F 5/00
See application file for complete search history.

(56) References Cited

U.S. PATENT DOCUMENTS

2014/0225331 A1* 8/2014 Hozumi ..... H01H 21/08 277/500
2018/0287521 A1* 10/2018 Hikawa ..... H02K 11/28

FOREIGN PATENT DOCUMENTS

JP 2006-231494 A 9/2006

* cited by examiner

*Primary Examiner* — Anthony R Jimenez
(74) *Attorney, Agent, or Firm* — Metrolex IP Law Group, PLLC

(57) ABSTRACT

A trigger switch may include a first urging member urging a trigger, a shaft including a first end attached to the trigger, a first movable member connected to a second end of the shaft, a second movable member, a second urging member located between the first movable member and the second movable member, and a contact portion to be in contact with the second movable member moved in a depressing direction. In response to a depressing operation on the trigger, the first movable member, the second movable member, and the second urging member move in the depressing direction until the second movable member comes in contact with the contact portion. In response to an additional depressing operation on the trigger with the second movable member in contact with the contact portion, the first movable member moves in the depressing direction, and the second urging member urges the first movable member.

10 Claims, 7 Drawing Sheets

TRIGGER SWITCH

CROSS-REFERENCE TO RELATED APPLICATION

This application claims priority to Japanese Patent Application No. 2020-202102 filed on Dec. 4, 2020, the contents of which are incorporated herein by reference.

FIELD

The disclosure relates to a trigger switch that drives a drive in response to a depressing operation on a trigger.

BACKGROUND

For example, Patent Literature 1 describes, as one trigger switch for controlling the operation of a power tool, a trigger switch that may change the rotational speed of a motor. The trigger switch described in Patent Literature 1 includes a trigger that is depressed to power the motor, and then is depressed further to increase the voltage supplied to the motor and increase the rotational speed of the motor. The trigger includes a speed regulating dial for adjusting the maximum rotational speed of the motor.

In addition to the trigger switch described in Patent Literature 1, various other trigger switches are available for increasing the rotational speed of a motor in accordance with the stroke of a trigger. Such trigger switches may have an inflection point at which the rate of increase of the rotational speed of the motor changes between the start and the end of a depressing operation on the trigger.

CITATION LIST

Patent Literature

Patent Literature 1: Japanese Unexamined Patent Application Publication No. 2006-231494

SUMMARY

However, the trigger switch having an inflection point during a depressing operation is to provide a tactile sensation of the inflection point.

One or more embodiments are directed to a trigger switch that provides a tactile sensation for a change during a depressing operation.

A trigger switch according to one or more embodiments may include a trigger movable in response to a depressing operation, a first urging member urging the trigger in a direction opposite to a depressing direction in which the trigger is depressed, a shaft having a length parallel to the depressing direction and including a first end attached to the trigger and a second end, a first movable member connected to the second end of the shaft and movable in the depressing direction, a second movable member located adjacent to the first movable member in the depressing direction and movable in the depressing direction, a second urging member located between the first movable member and the second movable member to urge the first movable member and the second movable member in a direction away from each other, and a contact portion to be in contact with the second movable member moved in the depressing direction. In response to a depressing operation on the trigger, the shaft, the first movable member, the second movable member, and the second urging member move in the depressing direction in response to movement of the trigger receiving the depressing operation. The first urging member urges the trigger in a direction opposite to the depressing direction by an amount corresponding to a depressed amount of the trigger. In response to an additional depressing operation on the trigger with the second movable member moved and in contact with the contact portion, the shaft and the first movable member move in the depressing direction in response to movement of the trigger receiving the additional depressing operation. The second urging member urges the first movable member in the direction opposite to the depressing direction in an amount corresponding to a distance between the first movable member and the second movable member.

In the trigger switch according to one or more embodiments, the first urging member and the second urging member include elastic members.

The trigger switch according to one or more embodiments further includes a housing accommodating the first movable member, the second movable member, and the second urging member. The housing includes a wall having a through-hole receiving the shaft. The first urging member is wound around the shaft and includes one end in contact with a portion of the wall surrounding the through-hole in the housing.

In the trigger switch according to one or more embodiments, the first movable member and the second movable member are engaged with each other to be within a predetermined distance.

The trigger switch according to one or more embodiments further includes a controller that outputs a drive signal for driving a drive at a driving speed corresponding to a depressed amount of the trigger. The driving speed increases, in response to a change in the depressed amount, at different ratios before and after the second movable member comes in contact with the contact portion.

The trigger switch according to one or more embodiments may include the urging members to produce advantageous effects including an improved tactile sensation for a change in an operation load during a depressing operation.

DETAILED DESCRIPTION

One or more embodiments will now be described with reference to the drawings.

Example Use

A trigger switch according to one or more embodiments is usable in various electric devices such as electric drills, electric saws, electric screwdrivers, electric wrenches, electric grinders, and other power tools including a motor or another drive. In the embodiments below, a trigger switch TS will be described with reference to the drawings.

Embodiments

Figure 1:
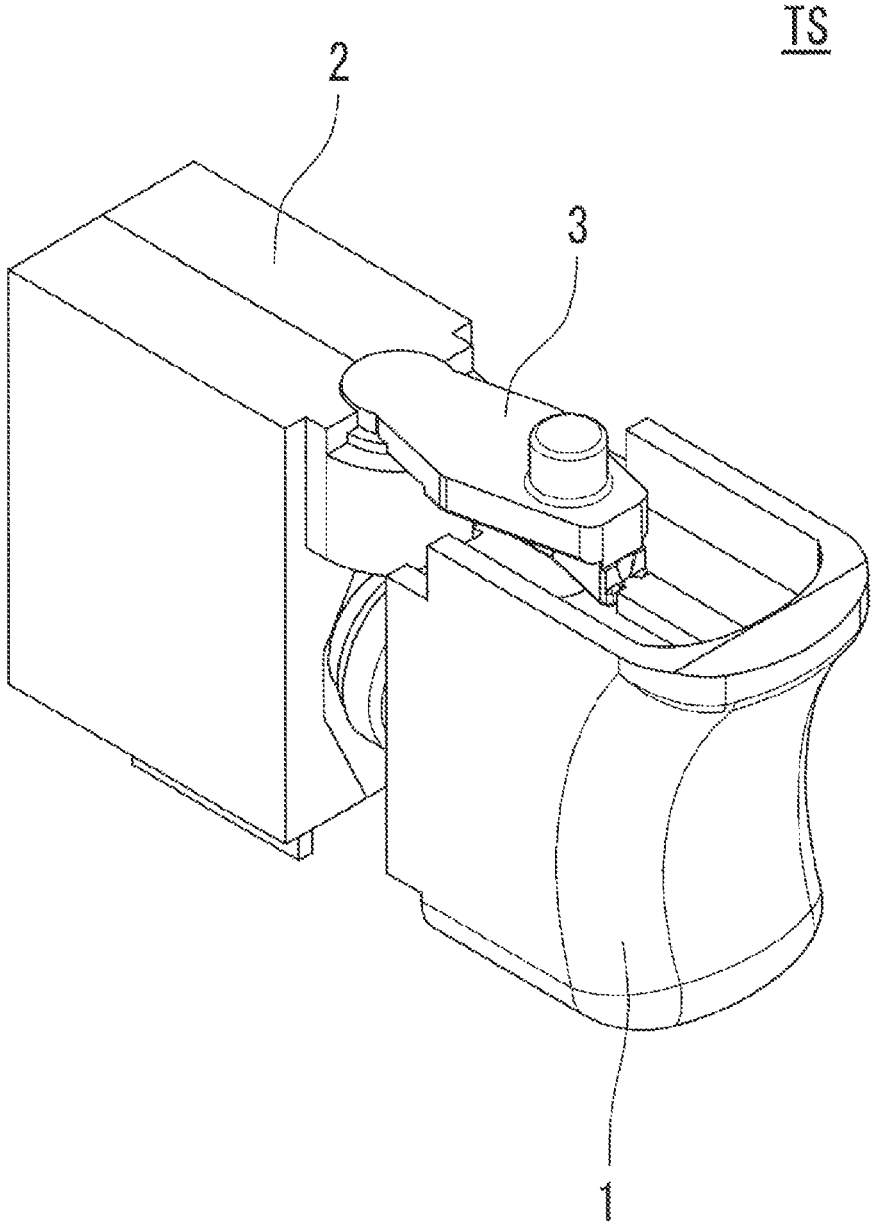
FIG. 1 is a diagram illustrating a schematic perspective view of a trigger switch showing an example appearance according to one or more embodiments.

FIG. 1 is a schematic perspective view of the trigger switch TS according to one or more embodiments, showing its example appearance. FIG. 1 shows the appearance of the trigger switch TS that may be incorporated into an electric device ET (with reference to FIG. 10) such as a power tool. The trigger switch TS is operable by an operator of the electric device ET. The operator depresses a trigger 1 in the trigger switch TS to drive a drive M (with reference to FIG. 10), such as an electric motor, incorporated in the electric device ET. The trigger switch TS includes a substantially rectangular housing 2 and the trigger 1. The housing 2 is incorporated into the electric device ET. The trigger 1 may be depressed by the operator. The trigger switch TS further includes a switch lever 3 for switching the driving direction of the drive M, or for example, the rotation direction of an electric screwdriver between the forward rotation and the reverse rotation. For ease of explanation and convenience, the orientation of the trigger switch TS is defined hereafter with the "front" referring to the surface on which the trigger 1 is attached, the "rear" referring to the housing 2, and a "rearward direction" referring to a depressing direction. However, this does not limit the orientation of the trigger switch TS in use.

Figure 2:
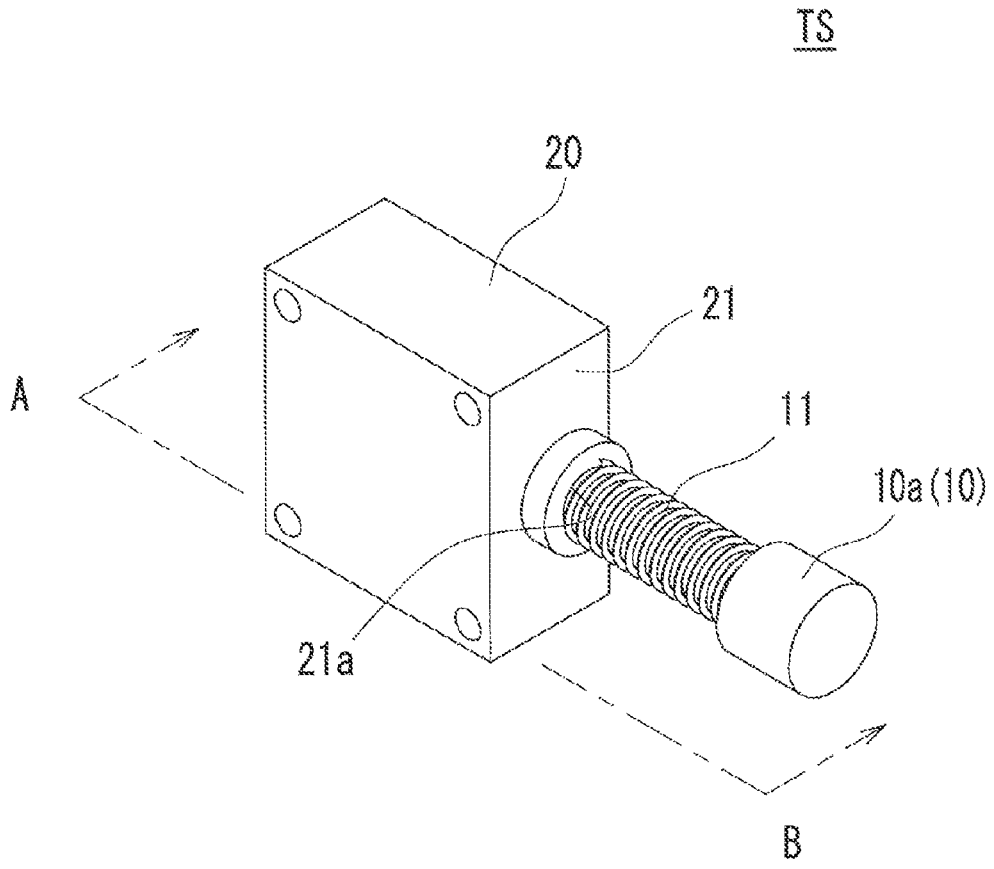
FIG. 2 is a diagram illustrating a schematic perspective view of a trigger switch showing exemplary main components according to one or more embodiments.

The internal structure of the trigger switch TS will now be described. FIG. 2 is a schematic perspective view of the trigger switch TS according to one or more embodiments, showing its example main components. FIG. 2 shows simplified main components as the mechanism incorporated in the trigger switch TS. The mechanism as the main components excludes the trigger 1 to expose a shaft 10 covered by the trigger 1, and includes a housing main part 20 to be a part of the housing 2 associated with a depressing operation on the trigger 1. The shaft 10 has a front first end receiving the trigger 1, and a second end extending through a through-hole 21*a* in a wall 21 of the front surface of the housing main part 20 and accommodated in the housing main part 20. The shaft 10 has a radially wider attachment 10*a* at a distal portion of a first end thereof. The shaft 10 receives a first urging member 11, which is wound therearound. The first urging member 11 may be a compressed coil spring. The first urging member 11 has a front end in contact with a rear end of the wider attachment 10*a*, and a rear end in contact with the wall 21 surrounding the through-hole 21*a* in the wall 21 of the housing main part 20. The first urging member 11 having the rear end in contact with an outer wall of the housing main part 20 urges the shaft 10 forward with the front end. In response to a depressing operation on the trigger 1, the shaft 10 moves rearward together with the trigger 1. In response to the depressing operation being released, the trigger 1 and the shaft 10 move forward as the first urging member 11 urges the trigger 1 forward, opposite to the depressing direction of the trigger 1.

Figure 3:
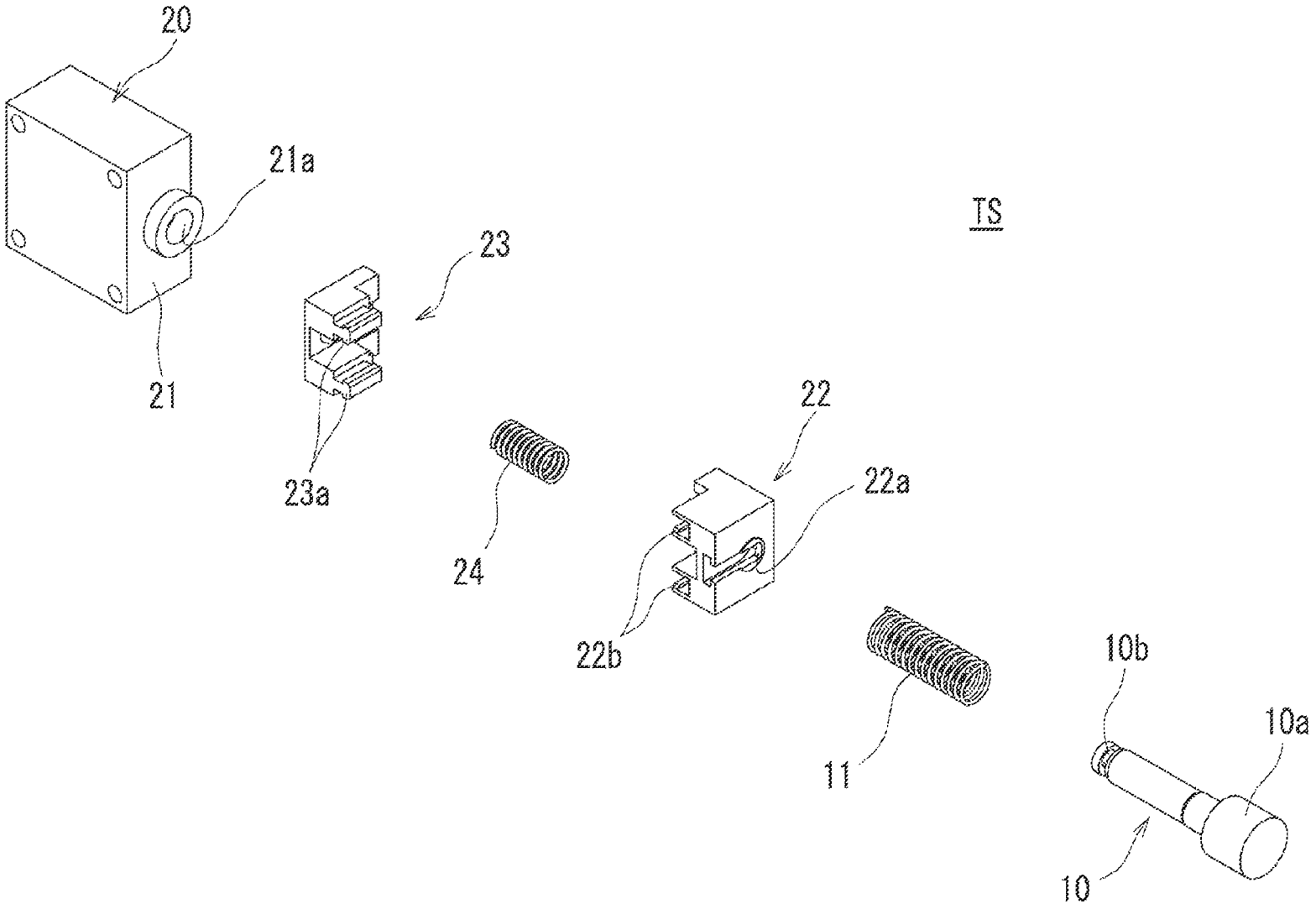
FIG. 3 is a diagram illustrating a schematic exploded perspective view of a trigger switch showing exemplary main internal components according to one or more embodiments.
Figure 4:
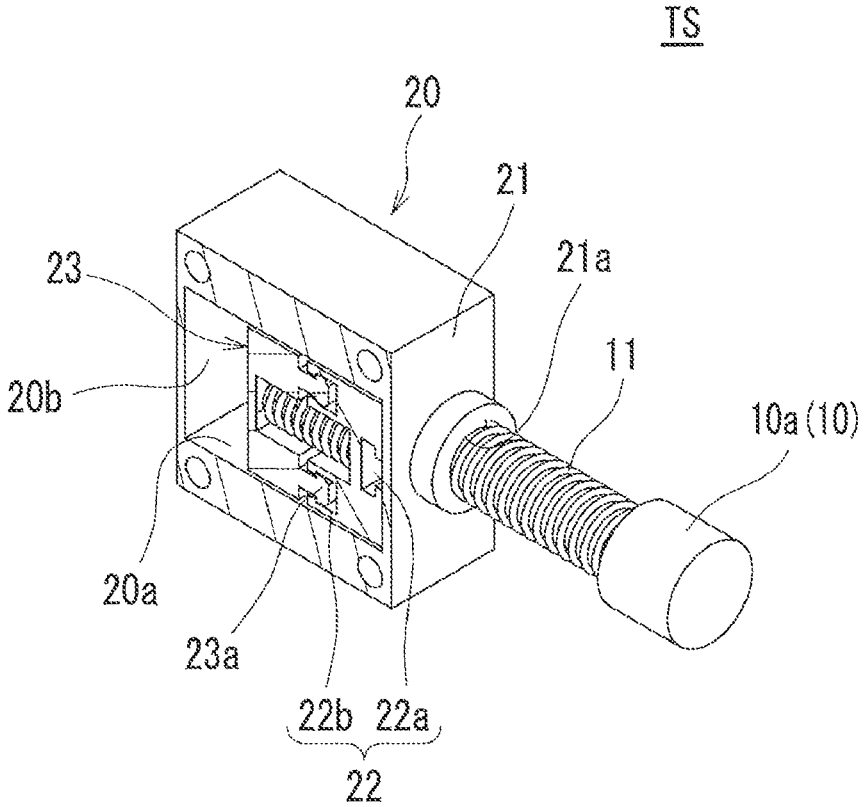
FIG. 4 is a diagram illustrating a schematic perspective view of a trigger switch showing a partial cut away of exemplary main components according to one or more embodiments.
Figure 5:
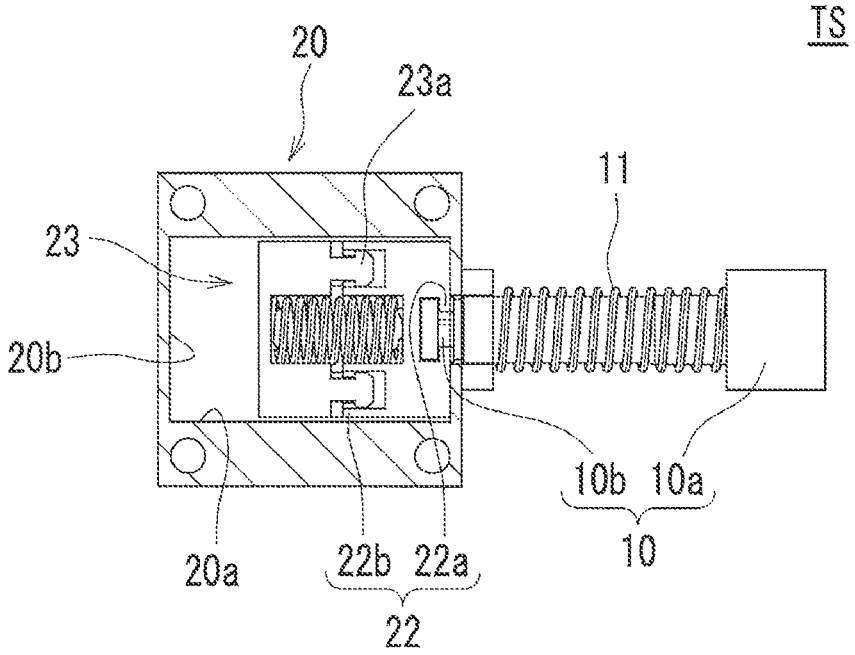
FIG. 5 is a diagram illustrating a schematic side view of a trigger switch showing a partial cut away of exemplary main components according to one or more embodiments.

FIG. 3 is a schematic exploded perspective view of the trigger switch TS according to one or more embodiments, showing its example main internal components. FIG. 4 is a schematic perspective view of the trigger switch TS according to one or more embodiments, showing its example main components partially cut away. FIG. 5 is a schematic side view of the trigger switch TS according to one or more embodiments, showing its example main components partially cut away. FIGS. 4 and 5 are cross-sectional views taken along a vertical plane along line A-B shown in FIG. 2, showing the main components inside the trigger switch TS partially cut away. The housing main part 20 accommodates, for example, a first movable member 22, a second movable member 23, and a second urging member 24, in addition to the second end as the rear end of the shaft 10.

The first movable member 22 and the second movable member 23 are substantially rectangular prisms and are movable back and forth along a guide path 20*a* extending in the front-rear direction (e.g., the rearward or depressing direction of the trigger 1) in the housing main part 20. The first movable member 22 is located at the front, and the second movable member 23 is located at the rear. The second movable member 23 at the rear may move and come in contact with a contact portion 20*b*, which is the rear end of the guide path 20*a*. The shaft 10 has, near a rear end thereof, an engagement groove 10*b* circumferentially recessed around the outer circumferential surface. The first movable member 22 has an engagement portion 22*a* on the front surface. With the engagement portion 22*a* receiving the engagement groove 10*b* on the shaft 10, the first movable member 22 is engaged. The engagement groove 10*b* on the shaft 10 is engaged with the engagement portion 22*a* of the first movable member 22 to connect the rear end of the shaft 10 to the front surface of the first movable member 22.

The first movable member 22 includes engagement female portions 22*b* in a rear thereof. The second movable member 23 includes engagement male portions 23*a* in a front thereof. The engagement female portions 22*b* of the first movable member 22 each include a recess into which a corresponding engagement male portion 23*a* of the second movable member 23 is placeable. The edge of the recess is bent inward to form a hook. The engagement male portions 23*a* of the second movable member 23 each include a tab placeable into a corresponding engagement female portion 22*b* of the first movable member 22. The tab has a distal end protruding outward. Each engagement male portion 23*a* of the second movable member 23 is placed into the corresponding engagement female portion 22*b* of the first movable member 22 in a movable manner. The engagement female portion 22*b* of the first movable member 22 has the edge engaged with the distal end of the engagement male portion 23*a* of the second movable member 23. This may allow the first movable member 22 and the second movable member 23, which are movable in the front-rear direction independently of each other, to be within a predetermined distance.

The second urging member 24 includes, for example, a compressed coil spring. The second urging member 24 is located between the first movable member 22 and the second movable member 23 and urges the first movable member 22 and the second movable member 23 in a direction away from each other. The second urging member 24 has a spring constant different from the spring constant of the first urging member 11. More specifically, the second urging member 24 includes a compressed coil spring with a spring constant greater than the spring constant of the first urging member 11. The second urging member 24 is compressed with a force greater than the force to compress the first urging member 11.

Figure 6:
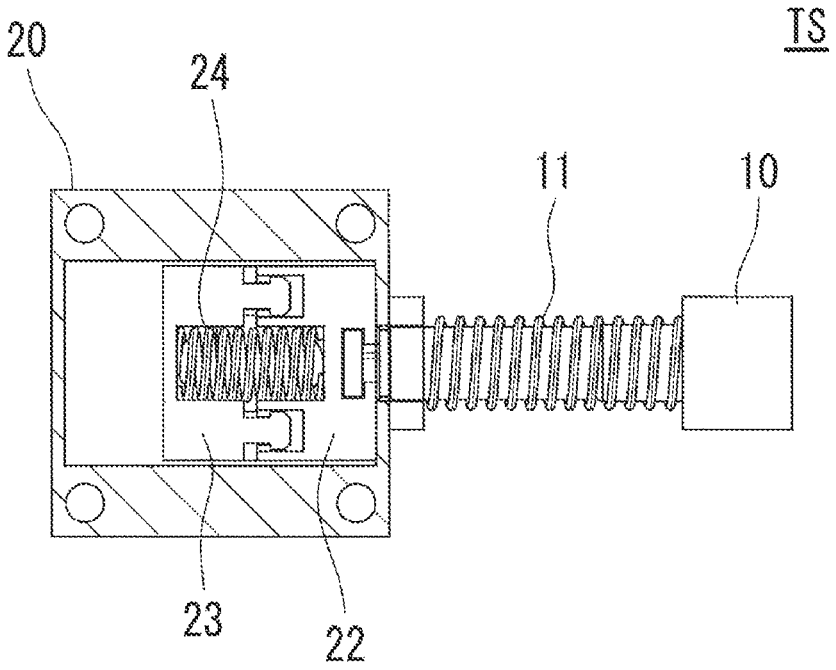
FIG. 6 is a diagram illustrating a schematic side view of a trigger switch showing a partial cut away of exemplary main components according to one or more embodiments.

An operation and a movement of the trigger switch TS according to one or more embodiments will now be described. FIG. 6 is a schematic side view of the trigger switch TS according to one or more embodiments, showing its example main components partially cut away. In FIG. 6, the trigger 1 is not depressed. In the state illustrated in FIG. 6, the shaft 10 is urged by the first urging member 11 to move forward. The trigger 1, which is attached to the front end of the shaft 10, is at the front end of a movable range thereof, although this is not shown in FIG. 6. The first movable member 22, which is connected to the rear end of the shaft 10 located forward, is at the front end of a movable range thereof. The second movable member 23 urged rearward by the second urging member 24 is engaged with the first movable member 22 away from the first movable member 22 by a predetermined distance.

Figure 7:
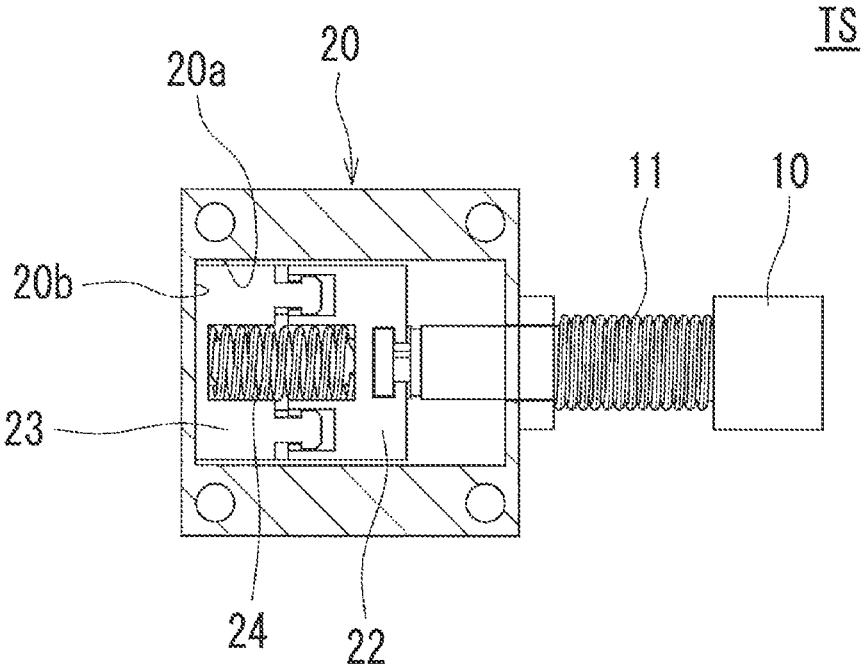
FIG. 7 is a diagram illustrating a schematic side view of a trigger switch showing a partial cut away of exemplary main components according to one or more embodiments.

FIG. 7 is a schematic side view of the trigger switch TS according to one or more embodiments, showing its example main components partially cut away. In FIG. 7, an operator has depressed the trigger 1 in the state in FIG. 6 rearward to have the rear end of the second movable member 23 in contact with the contact portion 20*b*, which is a rear inner wall of the housing main part 20. The operator depresses the trigger 1 against the urging force from the first urging member 11 to have the rear end of the second movable member 23 in contact with the contact portion 20*b* of the housing main part 20. The shaft 10 receiving the trigger 1 moves rearward as the trigger 1 moves. The first urging member 11 is compressed by an amount corresponding to the depressed amount. The first urging member 11 urges the trigger 1 forward, opposite to the depressing direction, while being compressed by an amount corresponding to the depressed amount of the trigger 1. The first movable member 22, which is connected to the rear end of the shaft 10, and the second movable member 23 move rearward through the guide path 20*a* as the trigger 1 moves. During this rearward movement, the first movable member 22 and the second movable member 23 are urged by the second urging member 24 to maintain the predetermined distance in between.

Figure 8:
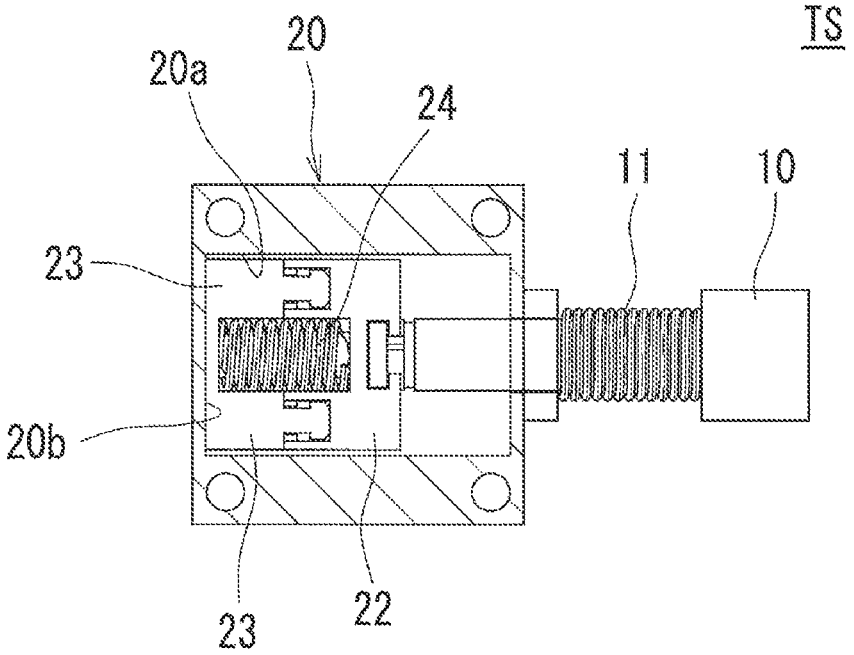
FIG. 8 is a diagram illustrating a schematic side view of a trigger switch showing a partial cut away of exemplary main components according to one or more embodiments.

FIG. 8 is a schematic side view of the trigger switch TS according to one or more embodiments, showing its example main components partially cut away. In FIG. 8, the operator has depressed the trigger 1 in the state in FIG. 7 more rearward to the limit of the depressing range. When the operator further presses the trigger 1 in the state in FIG. 7 with the rear end of the second movable member 23 in contact with the contact portion 20*b* of the housing main part 20, the trigger 1 is depressed against the urging force from the first urging member 11 and the second urging member 24. The shaft 10 receiving the trigger 1 moves more rearward as the trigger 1 moves. The first urging member 11 is further compressed by an amount corresponding to the depressed amount. While being compressed by an amount corresponding to the depressed amount of the trigger 1, the first urging member 11 urges the trigger 1 forward. The first movable member 22 connected to the rear end of the shaft 10 moves rearward through the guide path 20*a* as the trigger 1 moves. The second movable member 23 in contact with the contact portion 20*b* may not move rearward. The first movable member 22 thus moves rearward against the urging force from the second urging member 24, causing the second urging member 24 to be compressed by an amount corresponding to the depressed amount.

As described above, the operator depresses the trigger 1 in the trigger switch TS against the urging force from the first urging member 11 until the second movable member 23 comes in contact with the contact portion 20*b*. The operator then further presses the trigger 1 against the urging force from the first urging member 11 and the second urging member 24.

In response to the operator releasing the depressing operation on the trigger 1, the urging force from the first urging member 11 and the second urging member 24 returns the trigger 1 to the state in FIG. 6.

Figure 9:
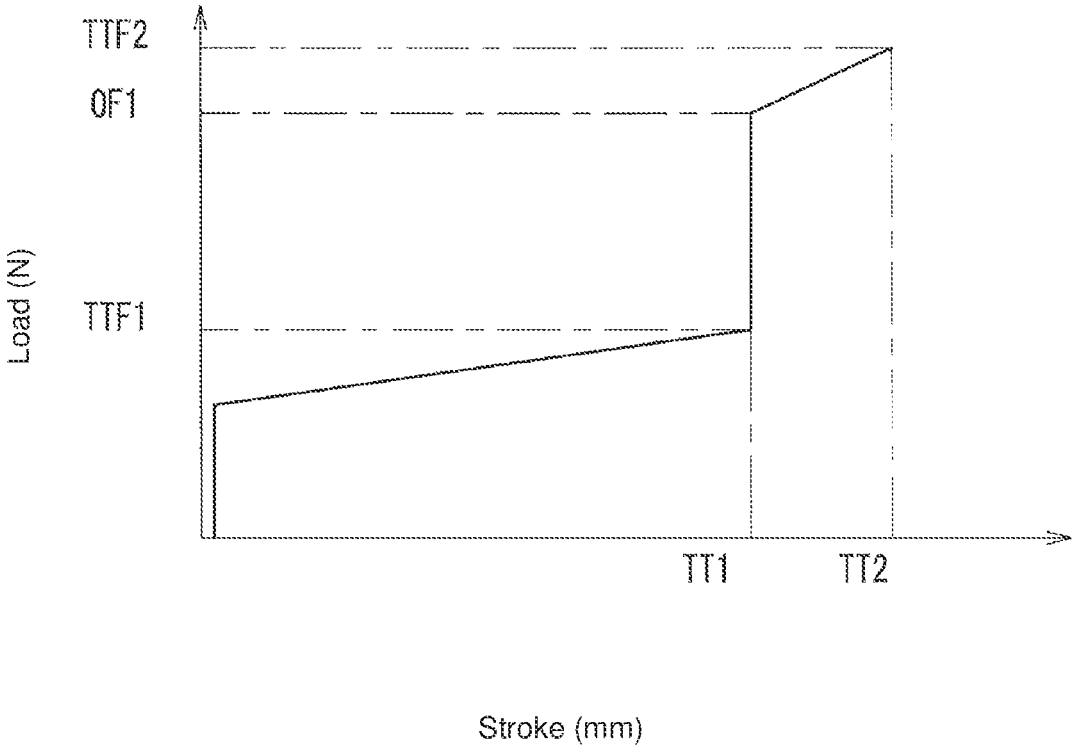
FIG. 9 is a graph illustrating a relationship between a depressed amount and an operation load for a trigger switch according to one or more embodiments.

The relationship between the depressed amount of the trigger 1 operated by an operator and the operation load for the depressing operation will now be described as an operational characteristic of the trigger switch TS according to one or more embodiments. FIG. 9 is a graph showing the relationship between the depressed amount and the operation load for the trigger switch TS according to one or more embodiments. In FIG. 9, the horizontal axis indicates the depressed amount of the trigger 1, which is referred to as a stroke, and the vertical axis indicates the load for operating the trigger 1. Upon the trigger 1 being depressed, substantially no load is applied. The play is defined. When depressed by an amount exceeding the play, the trigger 1 is depressed against the urging force from the first urging member 11. The load increases in accordance with the stroke amount. The inclination of the load relative to the stroke depends on the spring constant of the first urging member 11. In the graph, TT1 indicates the point at which the second movable member 23 comes in contact with the contact portion 20*b*, and TTF1 indicates the load at the point.

When further depressed from the point indicated by TT1, the trigger 1 is depressed against the resultant urging force from the first urging member 11 and the second urging member 24. The load increases to OF1 and then increases in accordance with the stroke amount. The inclination of the load relative to the stroke depends on the spring constants of the first urging member 11 and the second urging member 24. FIG. 9 shows the load TTF2 for the trigger 1 being depressed to TT2, which is the upper end of its depressing range.

The trigger switch TS according to one or more embodiments with the operational characteristic shown in FIG. 9 has an inflection point in a rate of increase of the rotational speed of the drive M, such as a motor, to be the point of TT1. The inflection point at the point TT1 may allow the operator to obtain a tactile sensation of the inflection point in the rate of increase as a change in the operation load. When, for example, the rotational speed gradually increases in accordance with the depressed amount until reaching the point TT1 and rapidly increases in accordance with the depressed amount beyond the point TT1, the operator may obtain a tactile sensation of the inflection point in the rate of increase of the rotational speed based on the change in the operation load. Similar effects as described above may be produced when the rotational speed rapidly increases in accordance with the depressed amount until reaching the point TT1 and gradually increases in accordance with the depressed amount beyond the point TT1. Similar effects as described above may also be produced when, for example, the rotational speed is constant for any depressed amount until reaching the point TT1 and increases in accordance with the depressed amount beyond the point TT1 or when the rotational speed increases until reaching the point TT1 and is constant beyond the point TT1.

Figure 10:
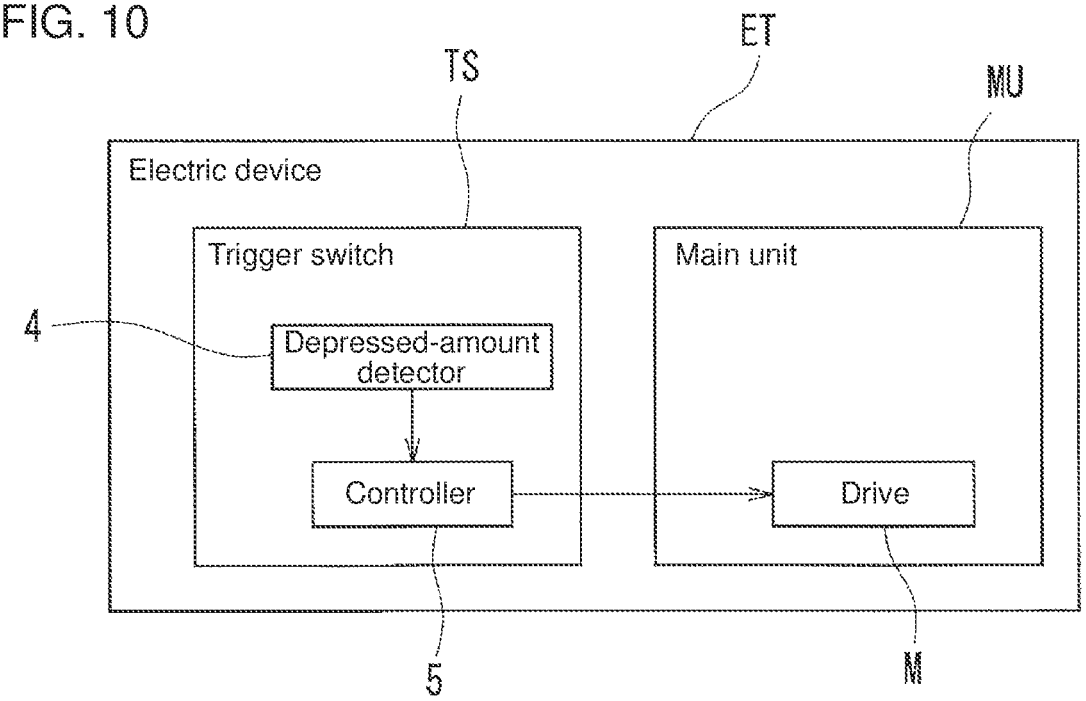
FIG. 10 is a schematic block diagram illustrating an electric device incorporating a trigger switch and an exemplary control configuration according to one or more embodiments.

An example configuration of the electric device ET incorporating the trigger switch TS according to one or more embodiments will now be described. FIG. 10 is a schematic block diagram of the electric device ET incorporating the trigger switch TS according to one or more embodiments. The electric device ET, such as a power tool, incorporates the trigger switch TS in a main unit MU. The main unit MU includes the drive M such as a motor. The trigger switch TS includes a depressed-amount detector 4, which detects the depressed amount of the trigger 1 and a controller 5, which outputs a drive signal to the main unit MU corresponding to the depressed amount.

The depressed-amount detector 4 detects a depressed amount either by contact or contactlessly. For a contact detection, electrodes may be attached to the housing main part 20 and the first movable member 22, and a depressed amount may be detected based on a resistance value that changes depending on a contact area of the electrodes. For a contactless detection, a contactless sensor, such as a proximity sensor that detects a change in the electric field, may be used to detect a depressed amount.

The controller 5 included in the trigger switch TS is, for example, a circuit including a printed wiring board and a microcomputer including integrated circuits such as large-scale integration (LSI) circuits or very large-scale integration (VLSI) circuits, electronic devices, and terminals mounted on the board. The controller 5 receives an input of a detection result from the depressed-amount detector 4, performs various types of processing in response to the detection result, and outputs, to the main unit MU, a drive signal for driving the drive M, such as a motor, included in the main unit MU of the electric device ET. The electric device ET drives the drive M in response to the drive signal input into the main unit MU.

As described above, the trigger switch TS according to one or more embodiments includes the first urging member 11, the second urging member 24, the first movable member 22, and the second movable member 23, which cooperate with one another to change the load during the depressing operation on the trigger 1. The trigger switch TS may be incorporated into the electric device ET having an inflection point in the rate of increase of the drive speed of the drive M relative to a depressed amount to produce advantageous effects including an improved tactile sensation of the inflection point as a change in the operation load.

One or more embodiments are not limited to the above description and may be modified in various manners. The above description is merely exemplary and not limiting. The technical scope of the present disclosure is defined not by the description given above but by the claims. Any modifications and alterations contained in the equivalency range of the claims fall within the scope of the invention.

For example, although the first urging member 11 and the second urging member 24 include compressed coil springs in the above-described embodiment or embodiments, other elastic members that have the equivalent capability may be used. For example, either or both the first urging member 11 and the second urging member 24 may include an elastic member such as a plate spring. Although the second urging member 24 has a spring constant greater than the spring constant of the first urging member 11 in the above description, the invention is not so limited. For example, the first urging member 11 may have substantially the same spring constant as or a spring constant greater than the spring constant of the second urging member 24.

For example, although the controller 5 is accommodated in the housing 2 in the above description, various modifications are possible in which, for example, the controller 5 may be external to the housing 2 but accommodated in the main unit MU.

The invention claimed is:

1. A trigger switch, comprising:

a trigger movable in response to a depressing operation;

a first urging member urging the trigger in a direction opposite to a depressing direction in which the trigger is depressed;

a shaft having a length parallel to the depressing direction, the shaft including a first end and a second end, the first end being attached to the trigger;

a first movable member connected to the second end of the shaft and movable in the depressing direction;

a second movable member located adjacent to the first movable member in the depressing direction, the second movable member being movable in the depressing direction;

a second urging member located between the first movable member and the second movable member to urge the first movable member and the second movable member in a direction away from each other; and a contact portion to be in contact with the second movable member moved in the depressing direction, wherein in response to the depressing operation on the trigger, the shaft, the first movable member, the second movable member, and the second urging member move in the depressing direction in response to movement of the trigger receiving the depressing operation, and the first urging member urges the trigger in a direction opposite to the depressing direction by an amount corresponding to a depressed amount of the trigger, and in response to an additional depressing operation on the trigger with the second movable member moved and in contact with the contact portion, the shaft and the first movable member move in the depressing direction in response to movement of the trigger receiving the additional depressing operation, and the second urging member urges the first movable member in the direction opposite to the depressing direction in an amount corresponding to a distance between the first movable member and the second movable member.

2. The trigger switch according to claim 1, further comprising:

a controller configured to output a drive signal for driving a drive at a driving speed corresponding to the depressed amount of the trigger, wherein the driving speed increases, in response to a change in the depressed amount, at different ratios before and after the second movable member comes in contact with contact portion.

3. The trigger switch according to claim 1, wherein the first movable member and the second movable member are engaged with each other to be within a predetermined distance.

4. The trigger switch according to claim 3, further comprising:

a controller configured to output a drive signal for driving a drive at a driving speed corresponding to the depressed amount of the trigger, wherein the driving speed increases, in response to a change in the depressed amount, at different ratios before and after the second movable member comes in contact with contact portion.

5. The trigger switch according to claim 1, wherein the first urging member and the second urging member each comprise an elastic member.

6. The trigger switch according to claim 5, further comprising:

a controller configured to output a drive signal for driving a drive at a driving speed corresponding to the depressed amount of the trigger, wherein the driving speed increases, in response to a change in the depressed amount, at different ratios before and after the second movable member comes in contact with contact portion.

7. The trigger switch according to claim 5, wherein the first movable member and the second movable member are engaged with each other to be within a predetermined distance.

8. The trigger switch according to claim 5, further comprising:

a housing accommodating the first movable member, the second movable member, and the second urging member, wherein the housing comprises a wall having a through-hole receiving the shaft, and the first urging member is wound around the shaft and comprises one end in contact with a portion of the wall surrounding the through-hole in the housing.

9. The trigger switch according to claim 8, wherein the first movable member and the second movable member are engaged with each other to be within a predetermined distance.

10. The trigger switch according to claim 8, further comprising:

a controller configured to output a drive signal for driving a drive at a driving speed corresponding to the depressed amount of the trigger, wherein the driving speed increases, in response to a change in the depressed amount, at different ratios before and after the second movable member comes in contact with contact portion.

* * * * *